US006588357B1

(12) United States Patent
Hobdy

(10) Patent No.: US 6,588,357 B1
(45) Date of Patent: Jul. 8, 2003

(54) FLEX COUPLING ARRANGEMENT BETWEEN UPPER AND LOWER TURRET STRUCTURES

(75) Inventor: Miles A. Hobdy, Houston, TX (US)

(73) Assignee: FMC Technologies, Inc., Chiago, IL (US)

( * ) Notice: Subject to any disclaimer, the term of this patent is extended or adjusted under 35 U.S.C. 154(b) by 0 days.

(21) Appl. No.: 10/119,188

(22) Filed: Apr. 9, 2002

Related U.S. Application Data

(60) Provisional application No. 60/282,675, filed on Apr. 9, 2001.

(51) Int. Cl.[7] ..... B63B 22/02
(52) U.S. Cl. ..... 114/230.1; 441/5
(58) Field of Search ..... 114/230.1, 230.12, 114/230.13; 441/3–5

(56) References Cited

U.S. PATENT DOCUMENTS 4,490,121 A 12/1984 Coppens et al.
4,637,335 A 1/1987 Pollack
4,955,310 A 9/1990 Pollack
5,336,020 A * 8/1994 Askestad ..... 405/224
5,468,166 A 11/1995 Breivik et al.
5,515,804 A 5/1996 Pollack
5,517,937 A 5/1996 Lunde
5,782,197 A 7/1998 Pollack
5,823,837 A * 10/1998 Boatman et al. ..... 441/5
5,893,334 A 4/1999 Poranski
5,957,076 A 9/1999 Pollack et al.

* cited by examiner

*Primary Examiner*—Stephen Avila
(74) *Attorney, Agent, or Firm*—Gary Bush; Andrews & Kurth

(57) ABSTRACT

A turret is supported on a vessel with bearing assemblies that permit the vessel to weathervane about the turret. The turret includes an upper turret structure, a lower turret structure, and a flex joint arrangement. The upper turret structure connects to the vessel with an upper turret bearing assembly and conical couplings. The conical couplings not only allow a smaller diameter bearing to be used on the upper turret, but also isolate the upper turret bearing assembly from ovaling of the vessel. A lower radial bearing assembly provides radial rotation support to a lower turret structure. A flex joint arrangement connects the upper and lower turret structures with a flex joint to minimize moments transferred from the lower turret structure to the upper bearing assembly. In one arrangement, the flex joint is located between the upper turret and a middle ring of the flex joint arrangment; and, in another arrangement, the flex joint is located between the lower turret structure and the middle ring of the flex joint arrangement.

14 Claims, 3 Drawing Sheets

FLEX COUPLING ARRANGEMENT BETWEEN UPPER AND LOWER TURRET STRUCTURES

RELATED APPLICATION

This application claims the benefit of U.S. Provisional Patent Application Ser. No. 60/282,675, filed Apr. 9, 2001.

BACKGROUND OF THE INVENTION

1. Field of the Invention

This invention relates generally to mooring systems and in particular to turret mooring systems. Still more particularly, the invention relates to a coupling or mounting arrangement for coupling an upper turret structure to a lower turret of a Floating Production, Storage and Offloading vessel (FPSO) or the like.

2. Description of the Prior Art

The prior art has provided mooring systems with turret structures having upper and lower portions which are rigidly coupled together. For example, in U.S. Pat. No. 5,316,509, an upper turret structure 30, on which a product swivel and manifold decks are placed, is rigidly secured to the top of the lower turret structure which is rotatably supported in a moonpool of the vessel by upper and lower bearing assemblies.

Other prior art patents have provided flexible bearing structures for rotatably supporting the lower turret structure. U.S. Pat. Nos. 4,955,310 and 5,515,804 are examples of flexible bearing supports. Other arrangements provide axial and radial springs to support the turret from the vessel.

3. Identification of Objects of the Invention

A primary object of this invention is to provide an improved turret arrangement for a vessel mooring system which reduces the cost and complexity of large diameter turret arrangements where several flexible fluid conduits are supported and housed within the turret.

Another object of the invention is to eliminate springs which have been used around the outside diameter of the turret bearing in the past.

SUMMARY OF THE INVENTION

The objects identified above, as well as other advantages and features are incorporated in an improved turret, which includes an upper turret structure characterized by an upper turret diameter, a lower turret structure characterized by a lower turret diameter which is larger than the upper turret diameter, and a flex joint arrangement between the upper and lower turret structures.

The upper turret structure is coupled to an upper portion of the vessel's moonpool wall by an upper axial/radial turret bearing assembly and a plurality of tubes which angle inwardly from the moonpool wall to a rigid-box ring on which the bearing assembly is mounted. The tubes are arrayed in a conical pattern and function not only to allow smaller diameter bearings to be used on the upper turret, but also isolate the upper axial/radial turret bearing assembly from ovaling of the vessel. The lower turret structure is coupled to a lower portion of the moonpool wall by a lower radial bearing assembly. A flex joint arrangement, which includes a middle ring, couples the upper turret structure to the lower turret structure while minimizing moments acting on the upper axial/radial turret bearing via a flex joint. Several embodiments of the flex joint arrangement are provided. In one embodiment, the flex joint is located at an upper ring of the upper turret structure. In another embodiment, the flex joint is located at the middle ring of the flex joint arrangement.

BRIEF DESCRIPTION OF THE DRAWINGS

The invention is described by reference to drawings of which.

DESCRIPTION OF THE INVENTION

Figure 1:
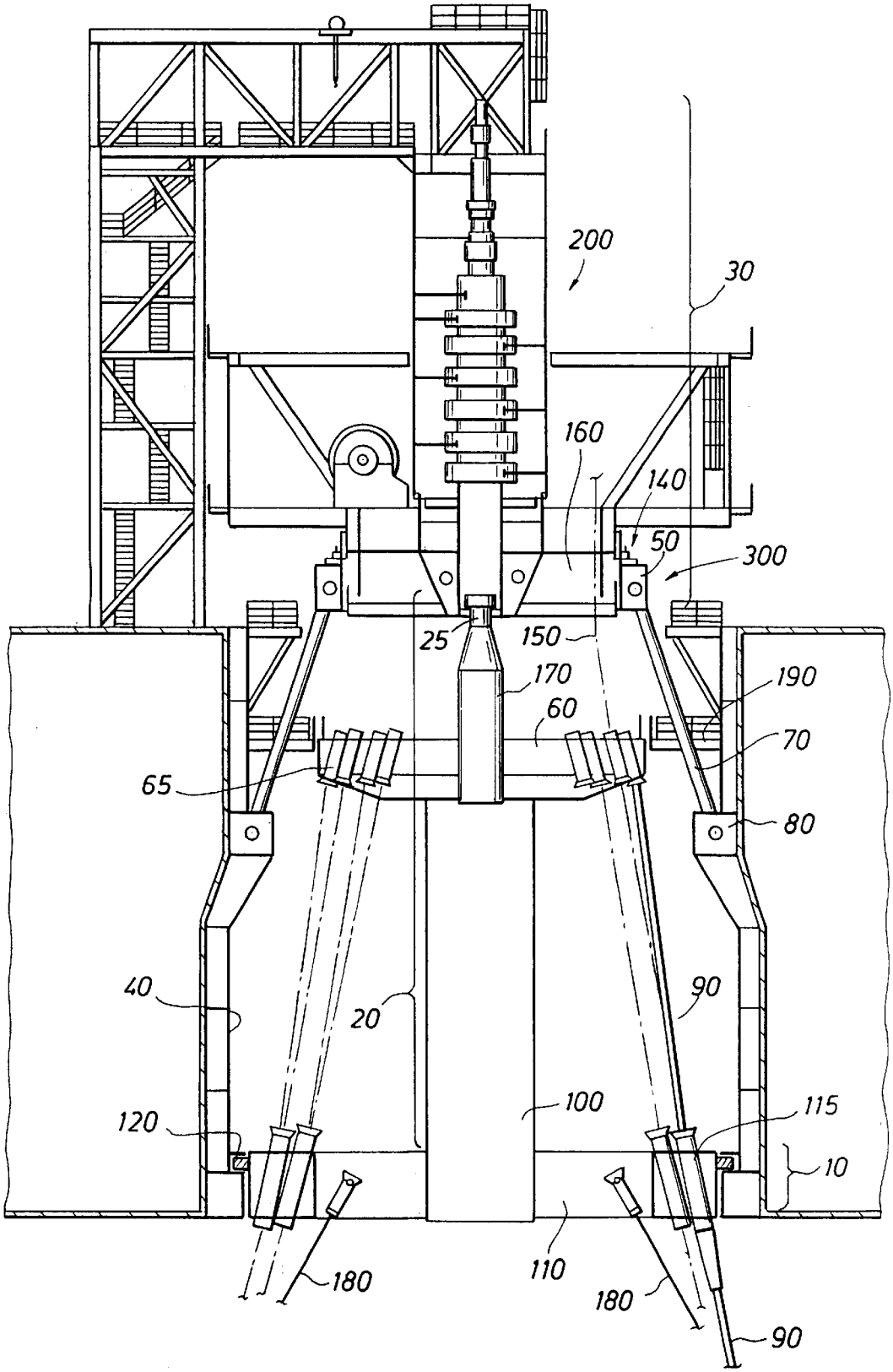
FIG. 1 is a cross-section of a turret mounted on a vessel showing a lower turret structure coupled to an upper turret structure by a flex joint arrangement, with a lower bearing support of the lower turret structure and an axial/radial turret bearing assembly of the upper turret structure.
Figure 2:
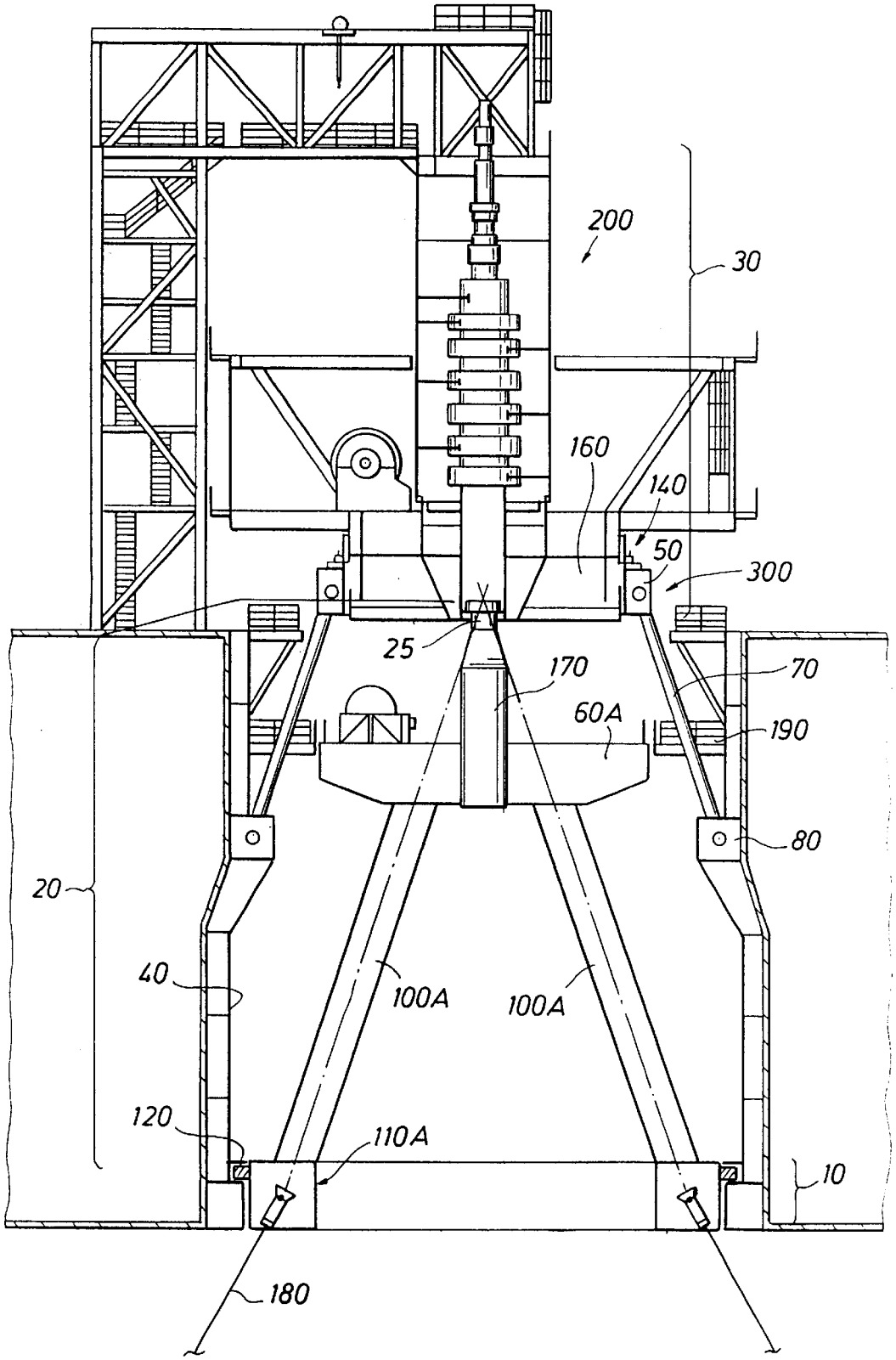
FIG. 2 is a cross-section of a turret mounted on a vessel showing an alternative embodiment of the flex joint arrangement from that of FIG. 1.
Figure 3:
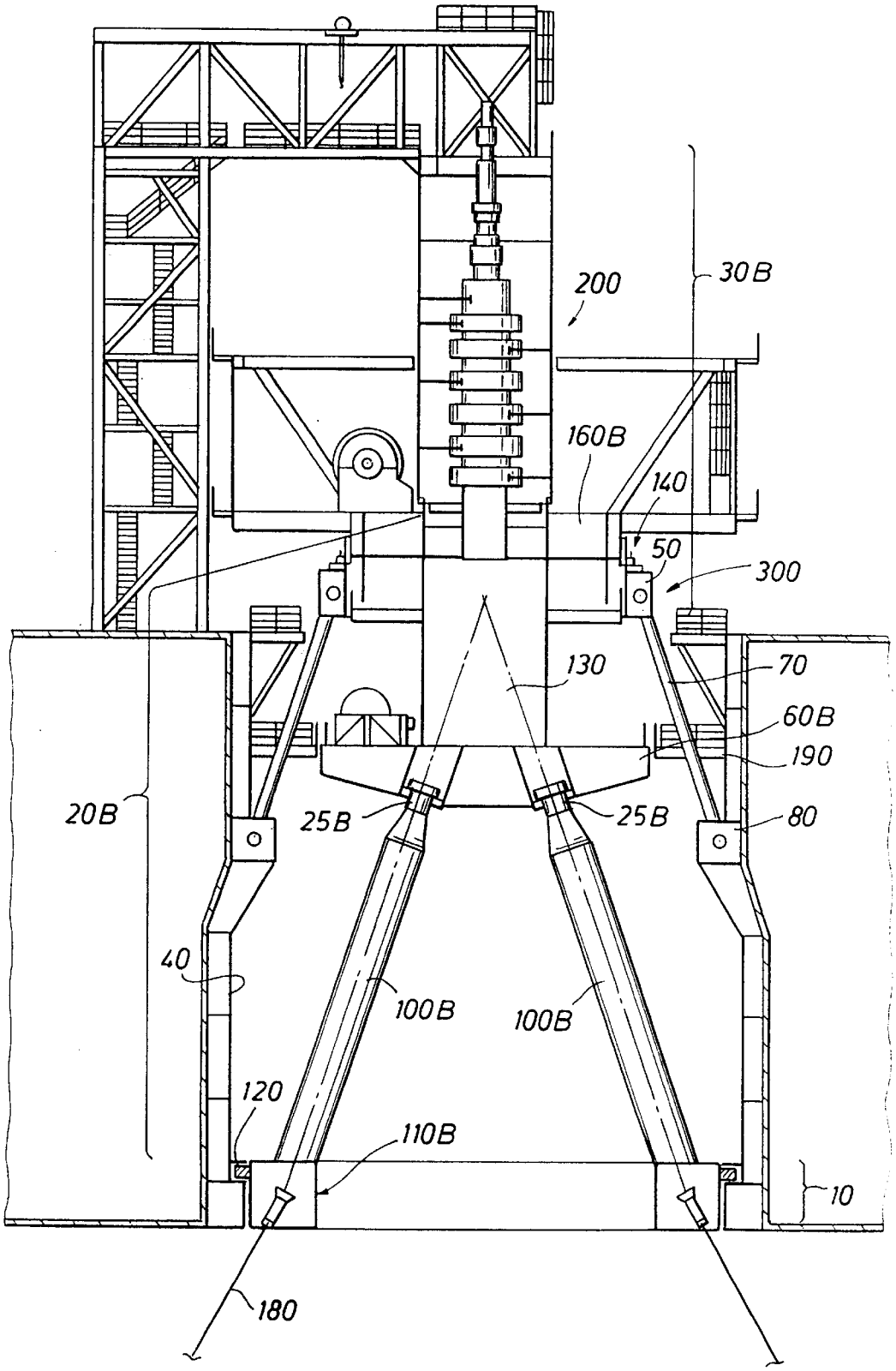
FIG. 3 is a cross-section of a turret mounted on a vessel showing another alternative embodiment of the flex joint arrangement.

The turret 300 of FIGS. 1, 2 and 3 includes one or more columns (100, 100A, 100B) coupled to a lower ring (110, 110A, 110B) where mooring lines 180 are connected and anchor the turret 300 to the sea floor. All the arrangements have one or more flex joints (25, 25B) by which an upper turret 30 is flexibly coupled in two degrees of freedom to a lower turret structure 10. As discussed above, prior art arrangements typically rigidly join the upper and lower turrets together, thereby requiring that springs be provided outside the axial/radial turret bearing. Springs arranged outside the diameter of the axial/radial bearing in the past have also acted as a decoupling mechanism such that the vessel hull deflection is not coupled into the bearing. The prior art arrangement of springs does not always solve the problem of additional forces generated on the axial/radial bearing due to turret misalignment and deflection. By decoupling two degrees of freedom between upper and lower turret structures (30, 10), via the flex joint arrangment 20, the adverse forces acting on the axial/radial bearing assembly 140 are mitigated.

The arrangements of FIGS. 1, 2 and 3 are advantageous. First, providing one or more flex joints (25, 25B) on turret 300 minimizes the coupling of moments from the lower turret structure 10 to the axial/radial turret bearing assembly 140. Furthermore, providing a plurality of rods or tubes 70 between upper and lower rigid rings (50, 80) serves to isolate the axial/radial turret bearing assembly 140 from vessel ovaling. The term "ring" as used herein includes structures or rings of circular shape or equivalent rings of square, rectangle, pentagon, hectagon, octagon shape and so on.

In FIG. 1, the turret 300 includes a lower turret structure 10, an upper turret structure 30, and a flex joint arrangement 20, therebetween. The lower turret structure 10 includes lower ring 110, which is rotatably coupled at a bottom portion of the moonpool wall 40 via lower bearing assembly 120. Lower ring 110 serves as a chain table and fixed support and includes lower protective conduits 115 for risers 90, which extend from the seabed (not shown). The risers 90 are flexible and can be hoisted through lower conduits 115 and upper conduits 65 above. Attached to lower ring 110 are a plurality of mooring lines 180, which anchor the turret 300 to the sea floor (not shown) in a substantially geostationary position.

The upper turret structure 30 includes upper ring 160 and equipment supported thereon such as decks for hoist mechanisms, product line swivel, etc. The upper ring 160 of the upper turret structure 30 is rotatably coupled to the vessel by an axial/radial bearing assembly 140 which is mounted on an upper rigid box ring 50. The upper rigid box ring 50 is coupled to a lower rigid box ring 80 which is fixed to moonpool wall 40. The coupling is by way of a plurality of rods or tubes 70 that are arranged in the shape of a frustum of a cone between the upper and lower rigid box rings (50, 80). Such an arrangement allows the upper ring 160 of the upper turret structure 30 to be of a smaller diameter than the lower ring 110 of the lower turret structure 10. The rods or tubes 70 also serve to substantially isolate the axial/radial bearing assembly 140 from ovaling of the vessel.

The flex joint arrangement 20 in the embodiment of FIG. 1 includes a single lower turret column 100, a middle ring 60, a small diameter rod or column 170, and a flex joint 25. The lower turret column 100 is secured to the lower ring 110 and extends up therefrom. The middle ring 60 is secured to the top end of the lower turret column 100 and provides a convenient place for mounting riser conduits 65 for risers 90 which extend upward from the lower riser conduits 115 at the chain table/lower ring 110. The riser conduits 65 are attached to production piping (schematically referenced as 150), which provide the flow path for hydrocarbons and the like from risers 90 up to the production equipment 200. The middle ring 60 is positioned adjacent a riser deck level 190 as shown in FIG. 1. The middle ring 60, as provided in the embodiment of FIG. 1, has a smaller diameter than the diameter of the lower ring 110. As a result, risers 90 which extend upwardly between the lower conduits 115 of the lower ring 110 and upper conduits 65 of the middle ring 60 angle inward as shown. In other words, the risers 90 are arranged in the shape of a frustum of a cone between the lower ring 110 and middle ring 60. A rod or column 170 extends upwardly from the lower turret column 100 and the middle ring 60, connecting with the flex joint 25.

The flex joint 25 of the flex joint arrangement 20 is coupled to the upper ring 160 of the upper turret structure 30. Depending on the geometry for a particular application, the flex joint 25 could be located below, at, or above the horizontal plane of the axial/radial turret bearing assembly 140. Advantages of such placement are described below. The upper and lower turret structures (30, 10) are also torsionally coupled via the flex joint arrangement 20, a feature not illustrated by the flex joint 25 illustration of FIG. 1.

In FIG. 2, an alternative embodiment of the flex joint arrangment 20 is shown where multiple lower turret columns 100A are connected between the middle ring 60A and the lower ring 110A. While not shown, risers 90 extending between lower ring 110A and middle ring 60A can be either internal or external to the columns 100A. For example, if the columns 100A are cylindrical and hollow and sufficiently large in diameter, the risers 90 can be placed inside of the columns 100A. The risers can also extend externally of columns 100A from lower ring 110A to middle ring 60A. The actual design and arrangement of columns 100A will depend on the dynamics of the system. As illustrated in this embodiment, the lower turret columns 100A are angled inwardly; however in other embodiments, multiple columns 100A can be vertically arranged.

In FIG. 3, another alternative embodiment is shown where the flex joint arrangment 20B includes a rigid connector or column 130 and one flex joint 25B per column. At least three columns 100B/flex joints 25 would be provided for a practical design. Rigid connector or column 130 connects the middle ring 60B to the upper turret structure 30B, while the flex joints 25B couple the lower turret columns 100B to the middle ring 60B. In this embodiment, the flex joints 25B of middle ring 60B are positioned a short distance below the riser deck level 190. As previously described by reference to FIG. 2, while not shown, risers can be provided either internally or externally to columns 100B, and the upper and lower turret structures (10B, 30B) are torsionally coupled via flex joint arrangement 20B.

It is preferred that the flex joint 25 (or joints 25B), as shown in FIGS. 1–3, take the configuration of a typical universal type (Hooke's joint), or a tapered stress joint of metallic or composite construction, or a flex joint using elastomeric or composite materials serving as the flexible element. Flex joints suitable for the embodiments of the invention are supplied by Oil States, Inc. of Arlington, Tex., U.S.A. Such flex joints have been used in the past for numerous Tension Leg Platform applications.

Positioning the flex joint or joints (25, 25B) close to the horizontal plane of the axial/radial turret bearing assembly 140 (as in FIGS. 1 and 2), coupled with the flex joint's (25 or 25B) two degree of freedom off motion (i.e., pivoting about horizontal axes through the joint) minimizes the moment loading on the axial/radial turret bearing assembly 140, thereby reducing its load bearing capacity requirements, and thereby reducing its cost. Also, the reduction in moment loading greatly reduces or eliminates the need for a flexible mounting between the axial/radial turret bearing assembly 140 and the moonpool wall 40 of the vessel structure. Elimination of flexible mountings between the axial/radial turret bearing assembly 140 and the moonpool wall 40 provides a simpler, more economical coupling than flexible/spring elements which are costly and mechanically complex. Further information about a flex joint used between an upper and lower turret structure is set forth in U.S. application Ser. No. 09/982,195 dated Oct. 19, 2001, which is incorporated herein.

It should be understood that the invention is not limited to the exact details of construction, operation, or embodiments shown and described, as obvious modifications and equivalents will be apparent to one skilled in the art. For example, while the term "vessel" and "moonpool" are used herein, it should be understood that the invention can also be used outboard, that is, outside a vessel's bulwark, for example, on an attached structure. The invention is therefore limited only by the scope of the claims.

I claim:

1. In a mooring arrangement which includes a vessel that can weathervane about a turret where the turret is anchored to the sea floor and is rotatably supported on said vessel, an improvement comprising:

said turret including an upper turret structure characterized by an upper turret diameter and a lower turret structure characterized by a lower turret diameter, wherein said upper turret diameter is smaller than said lower turret diameter, and wherein a flex joint arrangement connects said upper turret structure to said lower turret structure. whereby bending forces applied to said lower turret structure are reduced by said flex joint structure.

2. The mooring arrangement of claim 1, wherein said upper turret structure includes an upper ring, and said flex joint arrangement includes a middle ring and at least one flex joint which couples said upper ring of said upper turret structure to said middle ring of said flex joint arrangement.

3. The mooring arrangement of claim 2, wherein said flex joint is positioned at said upper ring of said upper turret structure, and a vertical member connects said flex joint to said middle ring of said flex joint arrangement.

4. The mooring arrangement of claim 2, wherein said lower turret structure includes a lower ring, and said flex joint arrangement includes a column arrangement which couples said middle ring to said lower ring.

5. The mooring arrangement of claim 4, wherein said column arrangement includes a vertical column.

6. The mooring arrangement of claim 4, wherein said column arrangement includes a plurality of columns which angle inwardly from said lower ring to said middle ring.

7. The mooring arrangement of claim 4, wherein risers angle inwardly from said lower ring to said middle ring.

8. The mooring arrangement of claim 4, wherein said column arrangement includes a single vertical column, said middle ring is characterized by a middle ring diameter, said lower ring is characterized by a lower ring diameter, and said middle ring diameter is smaller than said lower ring diameter.

9. The mooring arrangement of claim 8, wherein a plurality of risers extend between said lower ring and said middle ring and are arranged in the shape of a frustum of a cone.

10. The mooring arrangement of claim 4, wherein said upper ring of said upper turret structure is rotatably coupled to an upper rigid box ring by an upper bearing assembly, said upper rigid box ring is coupled to a lower rigid box ring via members arranged in the shape of a frustum of a cone, and, said lower rigid box ring is coupled to an interior wall of a moonpool.

11. The mooring arrangement of claim 1, wherein said upper turret structure includes an upper ring, said lower turret structure includes a lower ring, said flex joint arrangement is connected to said lower ring and includes a middle ring and at least one flex joint, and said at least one flex joint couples said upper ring of said turret structure to said middle ring of said flex joint arrangement.

12. The mooring arrangement of claim 11, wherein said flex joint arrangement includes at least one rigid connector which couples said upper ring to said middle ring.

13. The mooring arrangement of claim 10, wherein said flex joint is positioned at said upper ring close to a horizontal plane of said upper bearing assembly, whereby moment loading on said upper bearing assembly is reduced.

14. In a mooring arrangement which includes a vessel that can rotate about a turret where the turret is anchored to the sea floor and is rotatably supported on said vessel, an improvement characterized by, said turret including an upper turret ring and a lower turret ring and a flex joint structure which connects said upper turret ring to said lower turret ring, said flex joint structure providing damping of forces transferred to said upper turret ring when bending forces are applied to said lower turret ring.

* * * * *